US005345298A

United States Patent [19]

Corrigan, Jr.

[11] Patent Number: 5,345,298

[45] Date of Patent: Sep. 6, 1994

[54] MAGNETIC BRUSH DEVELOPMENT APPARATUS FOR TONER ADD/MIX DISPENSER

[75] Inventor: Richard W. Corrigan, Jr., Webster, N.Y.

[73] Assignee: Xerox Corporation, Stamford, Conn.

[21] Appl. No.: 139,960

[22] Filed: Oct. 20, 1993

[51] Int. Cl.[5] ..... G03G 15/06

[52] U.S. Cl. ..... 355/260; 222/DIG. 1; 355/245

[58] Field of Search ..... 355/260, 245, 251, 253; 222/DIG. 1; 118/656, 657, 658

[56] References Cited

U.S. PATENT DOCUMENTS

| | | | |
|---|---|---|---|
| 2,874,063 | 2/1959 | Greig | 117/17.5 |
| 4,173,405 | 11/1979 | Swapceinski et al. | 222/DIG. 1 X |
| 4,688,926 | 8/1987 | Manno | 222/DIG. 1 X |
| 4,690,540 | 9/1987 | Manno | 118/657 X |
| 4,963,940 | 10/1990 | Nemoto et al. | 355/260 |
| 4,969,011 | 11/1990 | Faull et al. | 355/260 X |
| 5,053,825 | 10/1991 | Trainor et al. | 355/260 |

*Primary Examiner*—A. T. Grimley
*Assistant Examiner*—Sandra L. Brasé

[57] ABSTRACT

A developer dispensing assembly for dispensing developer to an electrostatographic development apparatus has a developer dispensing tube, a toner supply at a first end of the tube, a developer supply adjacent the toner supply, an auger to transport toner and developer from the first end of the tube to the opposite end of the tube, the developer dispensing tube having an array of developer dispensing apertures arranged in a geometric pattern having a spatial relationship with respect to each other to dispense toner enriched developer through the apertures to the development apparatus at a substantially uniform dispensing profile as said developer and toner are transported from the first end of the tube to the opposite end of the tube for varied feed rates of developer and toner to the dispensing tube.

22 Claims, 8 Drawing Sheets

MAGNETIC BRUSH DEVELOPMENT APPARATUS FOR TONER ADD/MIX DISPENSER

BACKGROUND OF THE INVENTION

The present invention relates to electrostatographic printing apparatus and in particular to an automatic toner dispensing apparatus for use with two component development apparatus.

In the process of electrostatographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material such as paper and permanently affixed thereto.

This process is well known and useful for light lens copying from an original and in printing applications from electronically generated or stored originals.

FIG. 1 is representative of a common configuration in electrostatographic printing apparatus wherein a two component magnetic brush development apparatus comprising a rotatable developer roll 10 rotating about fixed magnets 11 in the direction indicated by the arrow creating a magnetic field to attract two component developer to the surface of the developer roll is trimmed by a trim bar 12 to provide a uniform thickness of developer on the developer roll 10 to present this layer of developer to the surface of the photoreceptor 13 which has an electrostatic latent image on it's surface to attract the toner material from the developer roll surface to the surface of the photoreceptor in image configuration which is subsequently transferred electrostatically by transfer corotron 14 to a substrate 15 such as ordinary paper which is then detacked from the surface of the photoreceptor by detack corotron 18 and transported to the fuser (not shown) for fixing to the substrate. Any toner remaining on the surface of the photoreceptor is cleaned therefrom by a cleaner blade 19 and transported to a cleaner sump (not shown) by an auger 20. The developer, which comprises carrier particles such as steel shot and very much smaller thermoplastic resin toner particles is housed in the developer sump 21 with a paddle wheel 22 to mix the developer and present it to the developer roll to continually provide a supply of developer to the magnetic brush development roll 10. For additional details of this process, attention is directed to U.S. Pat. No. 2,874,063 and for further information about the process, in general, attention is directed to the book *Electrophotography* by R. M. Schaffert, Enlarged and Revised Edition; 1975 published in the U.S. by Halsted Press, a division of John Wiley & Sons, New York, both of which are hereby incorporated by reference. In this process, the individual toner particles are charged and attracted to the image on the photoreceptor thereby depleting the total developer supply in the developer sump of toner particles. Accordingly, it is necessary to replenish the toner in the developer to maintain a sufficiently high concentration of toner to ensure satisfactory image density in the final print. One previous approach to doing this is illustrated in FIG. I and also FIG. 4, wherein freshly supplied toner is supplied to one end of a toner dispensing tube 24 from a toner hopper 23. As previously discussed, the level of developer on a developer roll is controlled by a trim bar 12, which directs the excess developer back to the developer sump. As illustrated in FIGS. 1 and 4, while a majority of the developer trimmed by the trim bar flows to a baffle 25 with the majority falling back into the paddle wheel sump 21, the baffle 25 has a feature, such as a bridge 28 that allows a small amount of developer to be fed into the dispense tube 24 through an opening 27 at the end of the dispense tube where freshly supplied toner is introduced from the toner hopper. The dispense tube has an auger 29 in the tube which mixes the new toner with the feedback developer in the tube from the bridge 28. This facilitates the handling of toner since developer flows much more readily than toner. Physically, the carrier in the developer is about ten times the size of the toner particles, is much greater in mass and density, has additional different material characteristics which enable the feeding of a much larger volume of developer because of the feedback of a portion of the excess developer than of the toner alone. In this particular machine configuration the requirements for replenishing toner are so small that the toner only flow rate along the length of the tube would be very low and it would be very difficult to handle the small amounts of toner because of tolerances and clearances between the auger and the tube. Accordingly, the feedback flow of developer to the dispensing tube enables a more efficient transport of newly supplied toner and developer down the tube since the ratio of the carrier to toner is from 50 to 100 to one by mass. From the dispense tube the toner enriched developer is supplied to a mixing chamber 31 which has a wobble plate mixer 32 and is augered from one end of the dispensing tube down to the other end of the dispensing tube. The toner enriched developer is supplied to the mixing chamber through a slot 33 (see FIG. 2) in the bottom of the tube which gets increasingly wider down the length of the slot from the toner and developer input end to the opposite end of the dispensing tube. The wobble plate cross mixing device 32 is well known and comprises a rotary device with eliptical plates off axis to mix the toner and developer as the toner is dispensed through the mix in the mixing chamber 31. A dividing plate 35 is provided to limit the area in which mixed developer can flow to the development chamber 36.

While capable of performing satisfactorily under certain conditions it has been discovered that the feedback flow rate of developer from the developer roll trim bar to the dispensing tube will vary depending on the strength of the magnetic roll and the pick up of developer from the surface of the developer roll which varies from machine to machine due to differences in manufacturing tolerances. This variation in feedback flow rate into the dispensing tube causes variations in the dispensing uniformity out of the tube and into the mix chamber with the slotted tube configuration as may be observed with reference to FIG. 3, which illustrates this distribution of developer and toner over the width of the dispense tube at four different feedback flow rates. For high flow rate there is initially a very high dispensing intensity and at low flow rates there is essentially none. This nonuniform distribution results in poor developer uniformity in the mixing chamber and the developer housing resulting in uneven development uniformity and poor print quality.

SUMMARY OF INVENTION

In accordance with a principle aspect of the present invention a developer dispensing assembly and two component development apparatus having the developer dispensing assembly is provided with a novel developer dispensing tube having an array of developer dispensing apertures arranged in a geometric pattern having a spatial relationship with respect to each other to dispense freshly toner enriched developer material through the apertures to the development apparatus at a substantially uniform dispensing profile as the toner enriched developer is transported from the first end of the dispense tube to the opposite end of the dispense tube for varied feed rates of developer and toner to the dispensing tube.

In a further aspect of the present invention the dispensing tube is substantially circular in cross section and has an auger to transport developer and toner from the first end to the opposite end of the tube.

In a further aspect of the present invention the apertures in the developer dispensing tube are circular and have the same cross sectional area.

In the further aspect of the present invention a toner hopper supplies a fresh supply of toner and the developer supply is a feedback of a portion of developer from the development apparatus. The developer dispensing apertures are at the bottom of the tube and parallel to the tube axis so that developer and toner flow by gravity through the apertures to the development apparatus.

In the further aspect of the present invention the geometric pattern of apertures comprises a primary group of in line apertures having a spatial frequency between adjacent apertures lesser at the first end of the dispensing tube than at the opposite end of the dispensing tube.

In a further aspect of the present invention the primary group of in line apertures are arranged in a plurality of sets of at least two apertures with the apertures of each set having a spatial frequency substantially the same and the apertures in successive sets from said first end to said opposite end being of increased spatial frequency with respect to the immediately preceding adjacent set.

In a further aspect of the present invention the geometric pattern includes at least one secondary group of in line apertures spaced above the primary group of in line apertures.

In a further aspect of the present invention a secondary group of in line apertures extends substantially from the first end of the tube to about the midpoint of the tube and includes at least one aperture at the end of the primary group of in line apertures.

In a further aspect of the present invention the dispensing assembly includes a developer bail out gate at the opposite end of the tube and includes an opening in the tube at the first end to receive developer from the development apparatus.

For a better understanding of the invention as well as other objects and further features thereof reference is had to the following drawings and descriptions.

DESCRIPTION OF THE PREFERRED EMBODIMENT

The invention will now be described by reference to a preferred embodiment.

Figure 1:
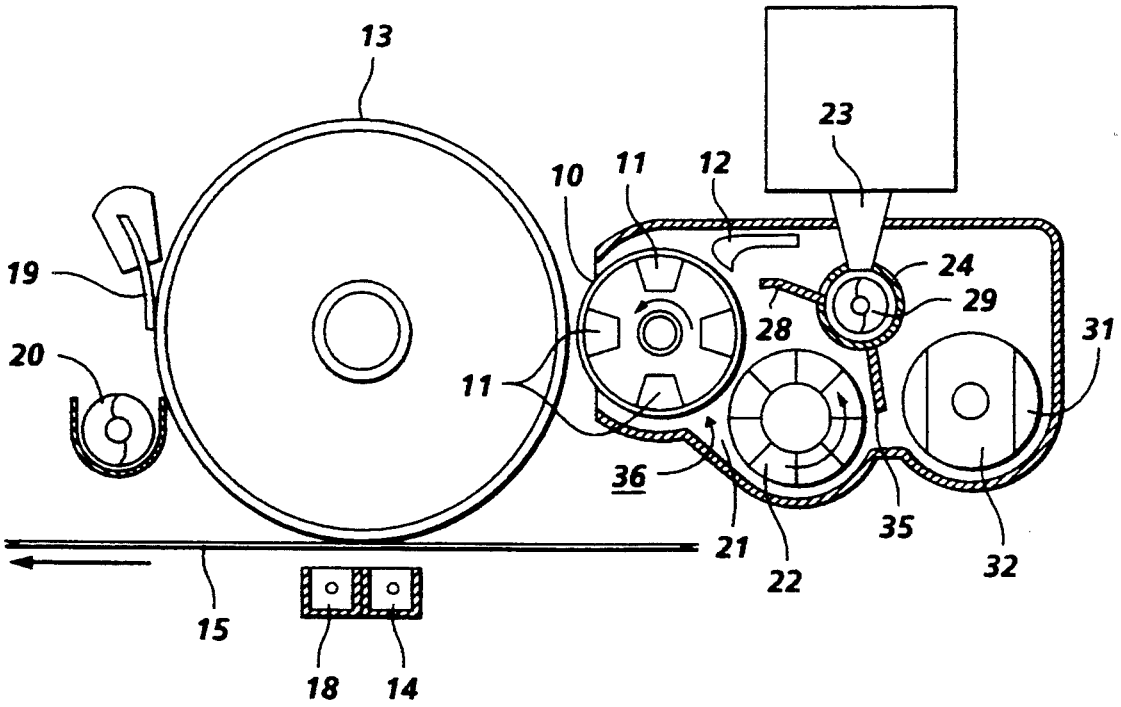
FIG. 1 is a schematic representation in cross section illustrating a typical electrostatographic printing apparatus which may employ the developer dispensing assembly according to the present invention.
Figure 2:
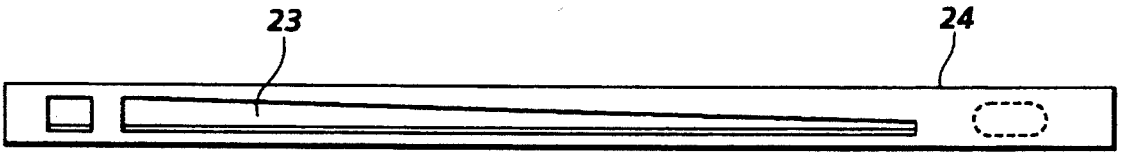
FIG. 2 PRIOR ART
FIG. 2 is a bottom view illustrating the slotted tube configuration according to prior art practice.
Figure 3:
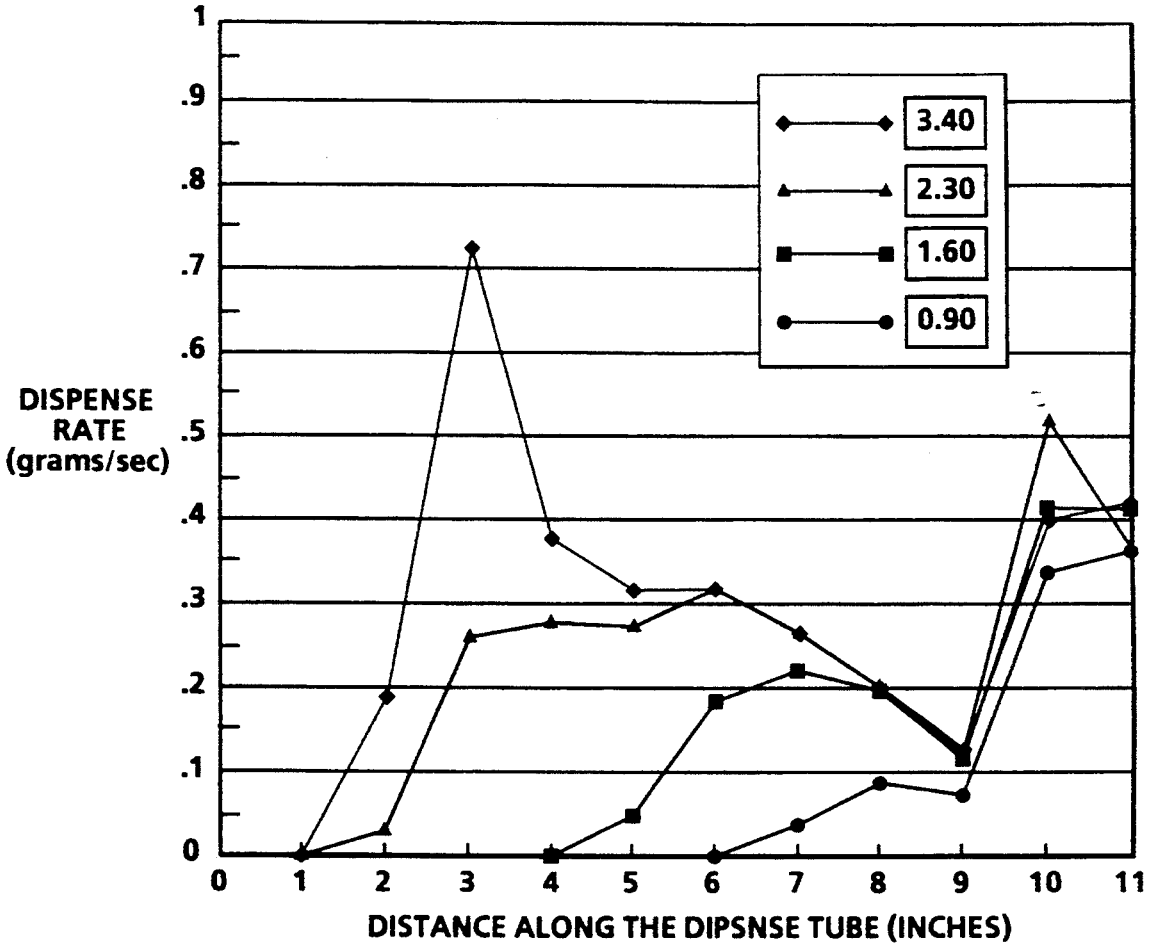
FIG. 3 is a graphical representation of the dispensing profile to the mixing chamber for the slotted configuration of FIG. 2 for various feedback flow rates to the dispensing tube.
Figure 4:
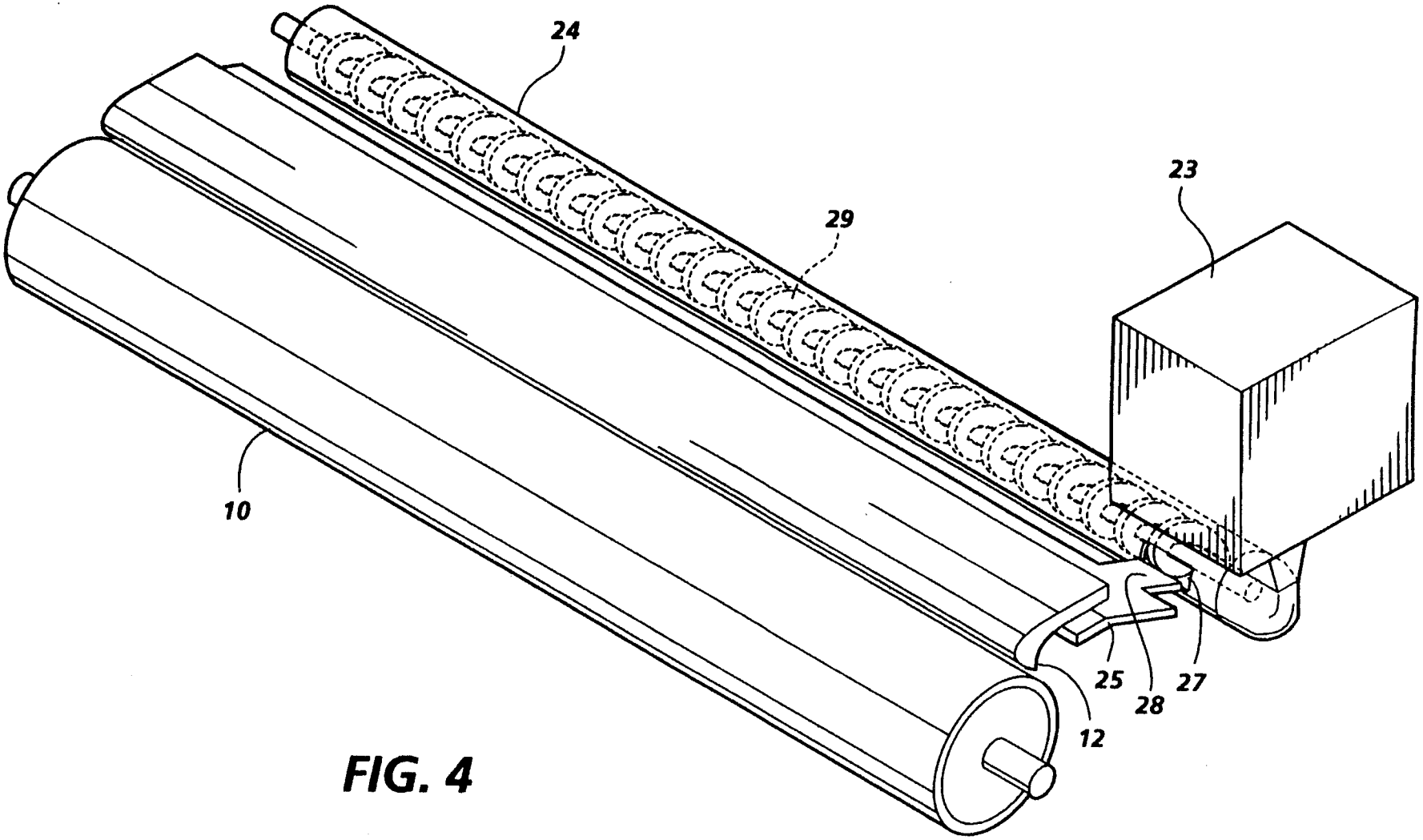
FIG. 4 is an isometric representation of the developer roll, developer trim bar, baffle, bridge to the dispensing tube for developer and the toner hopper at the first end of the dispensing assembly.

For ease of construction and explanation the invention will be described with reference to the apparatus illustrated and previously described in FIGS. 1 and 4 with the exception of the developer dispensing tube.

The developer dispensing assembly according to the present invention has a dispensing tube with an array 40 of developer dispensing apertures 41 arranged in a geometric pattern (see FIGS. 5 and 7) to dispense toner enriched developer therethrough to the development apparatus at a substantially uniform dispensing profile along the length of the tube for varied feed rates of developer and toner according to the following considerations. Both toner and developer material are introduced into a first end of the dispensing tube 24. The toner enriched development material is then transported down the tube by an auger 29. The developer material forms piles within the tube of a certain size and mass at the driving side of each auger pitch, depending on the flow rate into the tube, the tube and auger geometry, the auger speed and the flow characteristics of the developer material. These piles are driven and propagate through the tube toward the opposite end of the tube. The tube has an in line series of apertures or holes in it of equal size and as a pile of developer material passes over a hole, a percentage of the original mass of the pile is dispensed out of the aperture or hole thereby reducing the pile size and mass for the next hole it is to encounter. As the pile size diminishes the pile dwell time over successive holes is lessened thereby reducing the mass dispensed out of downstream holes relative to upstream holes. As a result of this continual incremental reduction of dispense rate per hole the whole spatial frequency is continually increased to gain an aggregate uniform dispense profile. The hole size, number of holes and varying spatial frequency are selected for the system geometry, auger speed and minimum flow rate of material entering the dispensing tube. If the hole size is too large and the initial spatial frequency too tight, the vast majority of material is dispensed toward the upstream end of the tube yielding an upstream skewed dispense profile.

The mass flow rate of toner and developer material into the tube may vary due to factors external to the dispensing tube which means that the dispensing tube needs to tolerate a range of flow rates and still deliver a substantially uniform dispensing profile along the length of the tube. As the input flow rate increases, the pile size and dwell time of the pile of each auger pitch continues to increase, as would the dispense duty cycle of a hole it passes over eventually overlapping with an adjacent auger pitch pile at which point a threshold or maximum 100 percent duty cycle hole dispense rate is reached. This saturation of hole dispense rate occurs first at the furthest upstream hole. As the flow rate continues to increase, more and more holes saturate going from upstream to downstream. During this increase in flow rate an increasing mass of material is augered toward the downstream end of the tube, any remaining toner enriched developer present at the end of the tube is dispensed out of a large bail out gate hole 43 (see FIG. 7). Once all of the holes reach saturation, the bail out gate hole flow rate continues to increase yielding a dispense profile spike at the downstream end of the tube.

To accommodate such high flow rate conditions at least one secondary group of in line equal size holes may be placed at some position above the primary in line group. These holes serve to uniformly distribute material that would have otherwise been pumped out the bail out gate hole. The number of holes and spatial frequency is selected for the process taking into consideration their interaction with an effect on the primary group of holes. These holes in the secondary group only become active under high flow rate conditions when the pile size height is large or high enough to reach that point on the dispense tube wall. As may be observed with reference to, in particular, FIGS. 5, 9A and 9B, the primary role of apertures while at the bottom of the tube is slightly offset to one side and therefore slightly up the side of the tube to both enable the toner enriched developer to be directed to the cross mixer and to ensure that there is some mixing of developer and newly applied toner. The secondary role of apertures is even further up the side of the tube and in some areas along the length of the tube where there is a low pile height does not dispense the toner enriched developer.

Figure 5:
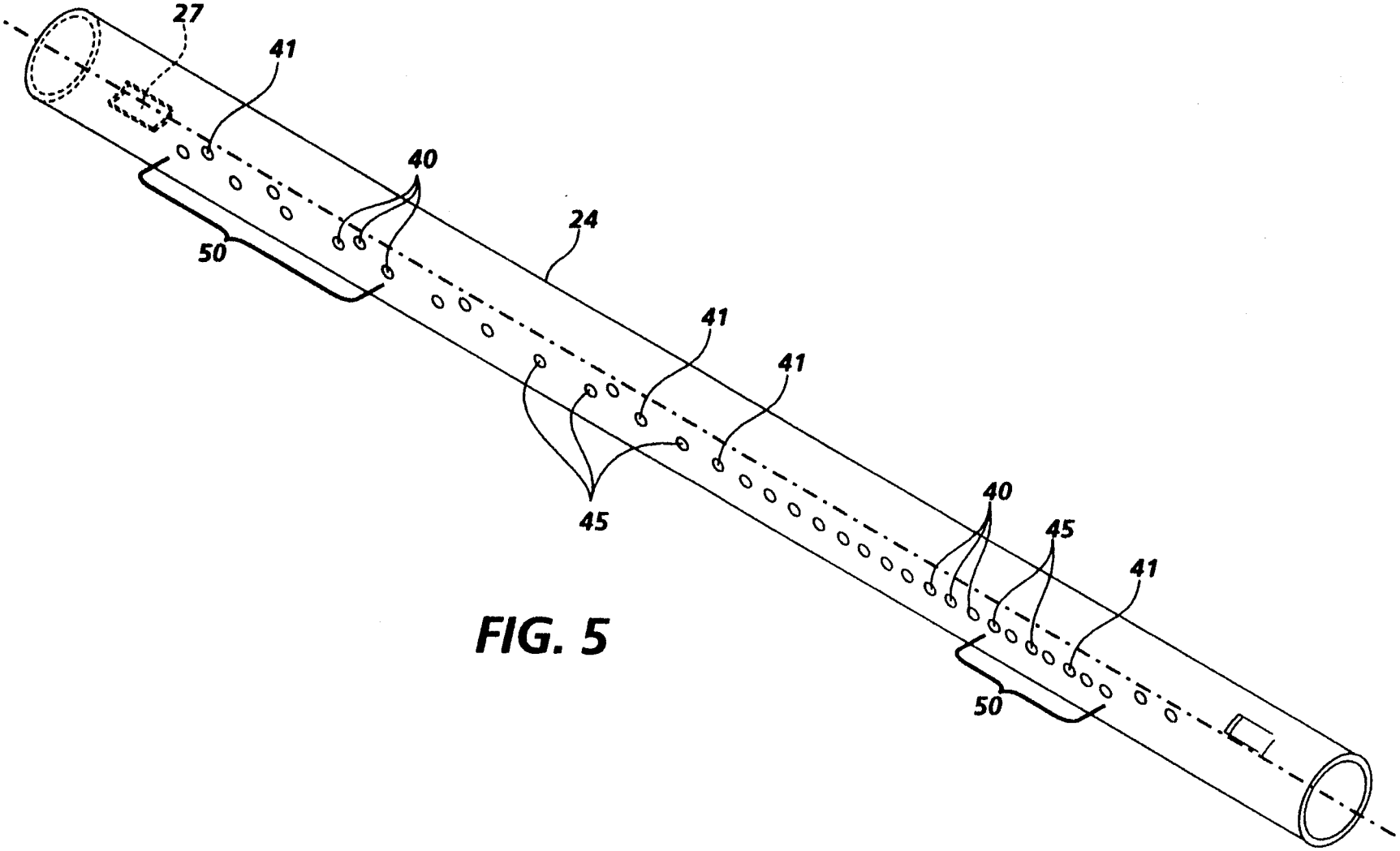
FIG. 5 is an isometric view of the dispensing tube according to the present invention with the apertures arranged in a geometric pattern.
Figure 7:
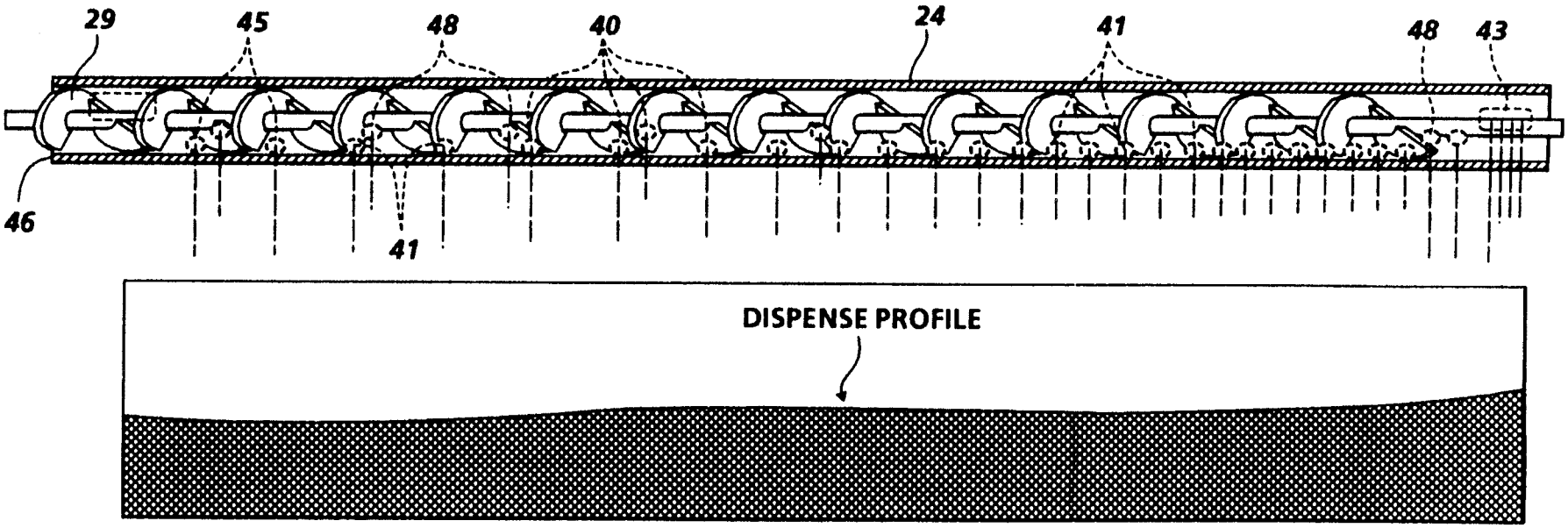
FIG. 7 is an illustration of a dispensing profile having progressively spaced apertures in a two level aperture configuration as illustrated in FIG. 5. The dispense profiles in FIGS. 6 and 7 are for feedback flow rates of 2.5 grams/second.

On the above considerations an array 40 of developer dispensing apertures in the dispensing tube 24 arranged is in a geometric pattern having a spatial relationship with respect to each other to dispense toner enriched developer through the apertures to the development apparatus at a substantially uniform dispensing profile for a variety of feedback rates of developer and toner to the dispensing tube. The array 40 of dispensing apertures 41 are circular and of the same general cross sectional area and are arranged in a line parallel to the axis of the dispensing tube which is also circular and contained therewith in a rotatable auger. The apertures are arranged at the bottom of the tube so that the developer and toner fall by gravity through the apertures to the development apparatus. The geometric pattern of the apertures includes a primary group 45 of in line apertures having a spatial frequency between adjacent apertures lesser than at the first end 46 of the dispensing tube 24 than at the opposite end of the dispensing tube and preferably has the apertures arranged in a plurality of sets of at least two apertures with the apertures of each set having a spatial frequency substantially the same in the apertures in successive sets from the first end to the opposite end of the dispensing tube and being of greater spatial frequency with respect to the immediately preceding adjacent set. (See FIGS. 5 and 7). As previously indicated to accommodate high flow rate conditions there is at least one secondary group 48 of in line apertures spaced above the primary group 45 of in line apertures in a line parallel to the axis of the dispensing tube. While only one secondary group of in line apertures is illustrated in FIGS. 5 and 7, it will be understood that for even higher flow rates of developer an additional line or two of apertures may be provided. However, as indicated in FIG. 7, the secondary group of in line apertures extend substantially from the first end of the tube 46 to about the midpoint of the tube and includes at least one aperture 48 at the end of the primary group 45 of in line apertures.

Figure 6:
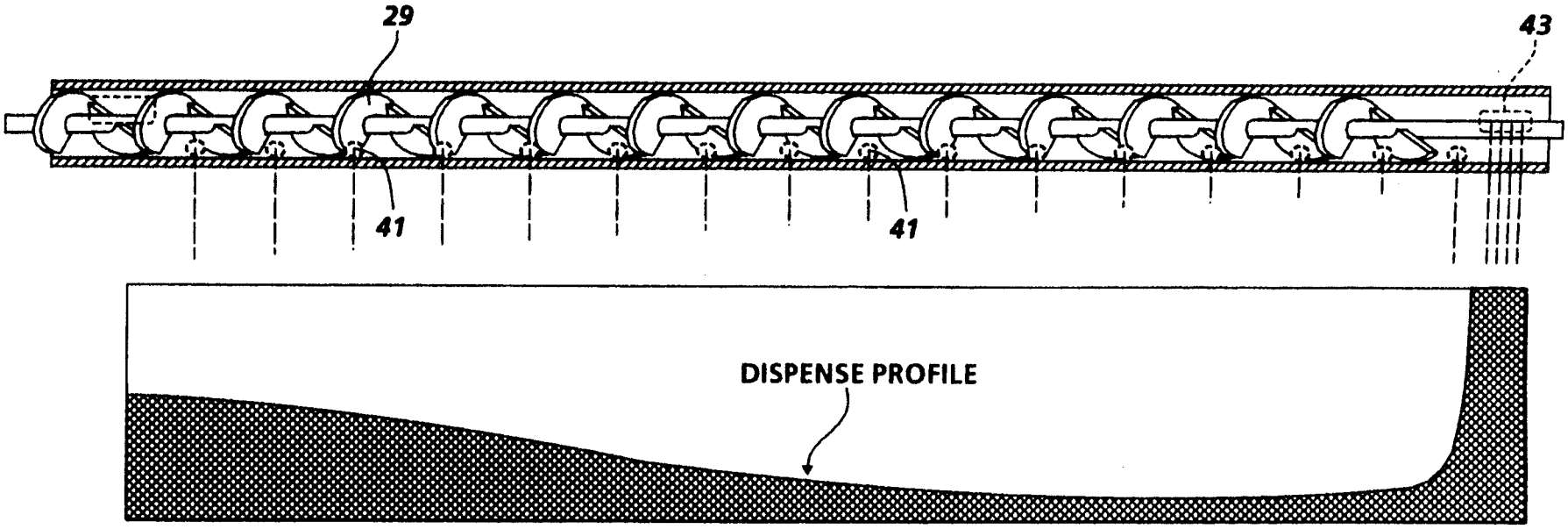
FIG. 6 illustrates the dispense profile of a dispensing tube having one level hole configuration with the apertures being evenly spaced.
Figure 8:
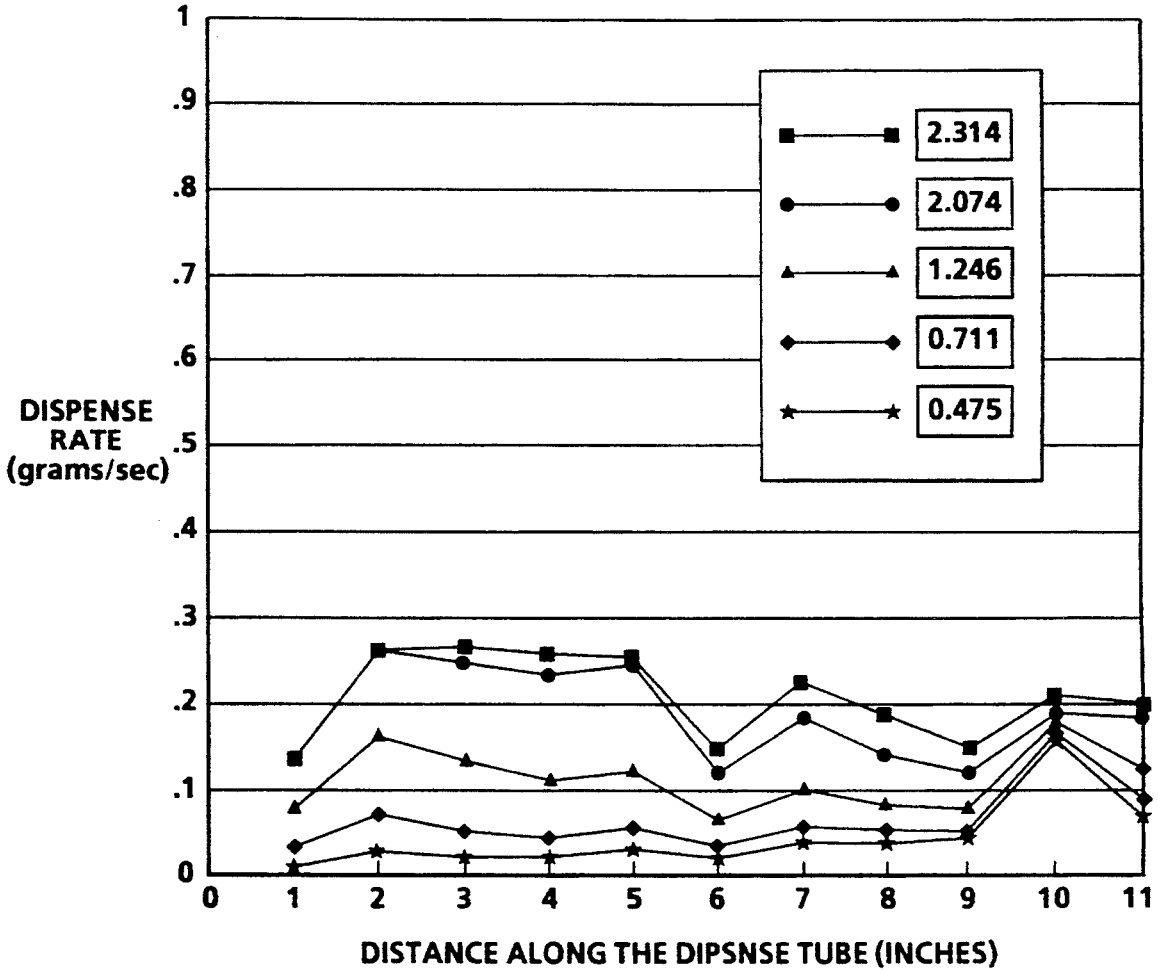
FIG. 8 illustrates the dispense profile of toner enriched developer to the mixing chamber for various feedback flow rates to the dispensing tube.
Figure 9A:
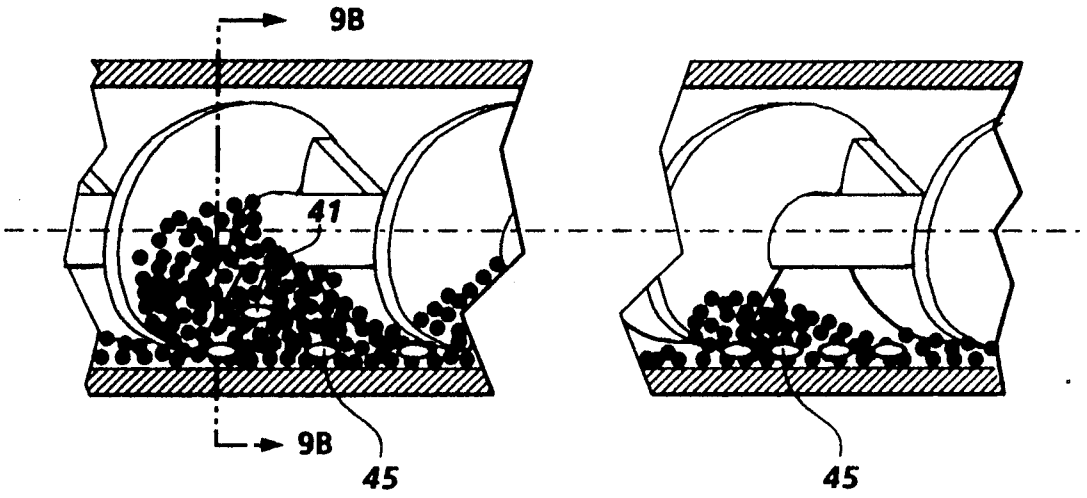
FIGS. 9A and 9B illustrate the two row design compensating for varying flow rates and pile heights.
Figure 9B:
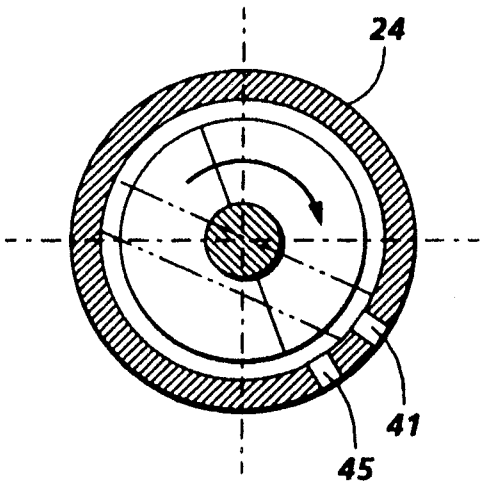

The developer dispense profile of this progressively spaced two level hole configuration is illustrated in FIG. 7 as is the bail out gate previously discussed. FIG. 6 is presented for comparative purposes to illustrate the aperture hole spacing and dispense profile for a dispensing tube have evenly spaced one level hole configuration. FIG. 8 illustrates the substantially uniform dispensing rate of developer and toner along the length of the dispense tube of FIGS. 5 and 7. FIG. 9 illustrates the total dwell time of varying pile heights over the dispensing hole. Thus, for a pile height such as that simulated in Section A of FIG. 9A toner enriched developer is dispensed from all the primary group of in line holes covered by the pile and also all the secondary group of in line holes in this section. However, as the pile height decreases due to depletion of toner enriched developer and its natural width for that height decrease the dispense duty cycle of downstream holes is gradually reduced initially from the secondary group of in line holes to a point where they no longer are dispensing toner enriched developer due to the apex of the pile being below them as illustrated in Section B. This reduction in dispense rate is compensated by increasing the spatial frequency of the primary group of in line holes to provide the desired substantially uniform dispense profile for varied developer feedback flow rates. The vertical position of any hole from a base of a pile will influence the dwell time of the pile over that hole since the work of a pile decreases from the maximum at the base of the pile to 0 at or just above the apex of the pile. In turn, the hole dispense duty cycle, the total hole flow rate per pile interaction on subsequent downstream holes and ultimate dispense profiles are effected.

Thus, according to the present invention a developer dispensing assembly has been provided which has a developer dispensing tube having an array of developer dispensing apertures arranged in a geometric pattern having a spatial relationship to dispense developer and toner as toner enriched developer to a development apparatus at a substantially uniform dispensing profile for a variety of feed rates of developer and toner. This enables a wider latitude in flow rate of the developer to the dispensing tube which may depend on magnetic field strength considerations as well as making it more tolerant to variations in process parameters.

The patents and text referred to specifically in this application are hereby incorporated herein by reference in their entirety in to the present application.

Thus, according to the present invention a printing apparatus with deferred jam clearance is provided. Furthermore, while the invention has been described with regard to electrostatographic printing apparatus, it will be understood that it has equal application to other types of printing and sheet handling devices. Furthermore, while the invention has been described with reference to a copier it has equal application to other machines such as printers where the image is electronically generated, Accordingly, it is intended to embrace all such alternatives and modifications as may fall within the spirit and scope of the appending claims.

I claim:

1. A developer dispensing assembly for dispensing developer to an electrostatographic development apparatus comprising a developer dispensing tube, a toner supply means at a first end of said tube, developer supply means adjacent said toner supply means, transport means to transport toner and developer from said first end of said tube to the opposite end of said tube, said developer dispensing tube having an array of developer dispensing apertures arranged in a geometric pattern having a spatial relationship with respect to each other to dispense toner enriched developer through said apertures to said development apparatus at a substantially uniform dispensing profile as said developer and toner are transported from said first end of said tube to said opposite end of said tube for varied feed rates of developer and toner to said dispensing tube.

2. The developer dispensing assembly of claim 1 wherein said dispensing tube is substantially circular in cross section and said transport means is a rotatable auger.

3. The developer dispensing assembly of claim 1 wherein said developer dispensing apertures have substantially the same cross sectional area.

4. The developer dispensing assembly of claim 3 wherein said apertures are substantially circular in cross section.

5. The developer dispensing assembly of claim 1 wherein said toner supply means is a toner hopper and said developer supply means is a slot for receiving a feedback portion of developer from the electrostatographic development apparatus.

6. The developer dispensing assembly of claim 1 wherein said developer dispensing apertures are at the bottom of said tube and parallel to the tube axis so that developer and toner fall by gravity through said apertures to the development apparatus.

7. The developer dispensing assembly of claim 1 wherein said geometric pattern of said apertures comprises a primary group of in line apertures having a spatial frequency between adjacent apertures is lesser at the first end of said tube than at the opposite end of said tube.

8. The developer dispensing assembly of claim 7 wherein said primary group of in line apertures are arranged in a plurality of sets of at least two apertures with the apertures of each set having a spatial frequency substantially the same and the apertures in successive sets from said first end to said opposite end being of greater spatial frequency with respect to the immediately preceding adjacent set.

9. The developer dispensing assembly of claim 7 wherein said geometric pattern includes at least one secondary group of in line apertures spaced above the primary group of in line apertures.

10. The developer dispensing assembly of claim 9 wherein said secondary group of in line apertures extend substantially from said first end of said tube to about the midpoint of said tube and includes at least one aperture at the end of the primary group of in line apertures.

11. The developer dispensing assembly of claim 10 including a developer bail out gate at the opposite end of said tube.

12. Two component magnetic brush development apparatus including means to deliver two component developer to a developer roll rotatable about at least one stationary magnet, a trim bar to control the level of developer on said rotatable developer roll, means to enable a portion of developer trimmed by said trim bar to be delivered to a developer dispensing assembly for initial contact with freshly dispensed toner, means to mix developer with freshly dispensed toner, said developer dispensing assembly comprising a developer dispensing tube, a toner supply means at a first end of said tube, developer supply means adjacent said toner supply means, transport means to transport toner and developer from said first end of said tube to the opposite end of said tube, said developer dispensing tube having an array of developer dispensing apertures arranged in a geometric pattern having a spatial relationship with respect to each other to dispense developer and toner through said apertures to said development apparatus at a substantially uniform dispensing profile as said developer and toner are transported from said first end of said tube to said opposite end of said tube for varied feed rates of developer and toner to said dispensing tube.

13. The development apparatus of claim 12 wherein said dispensing tube is substantially circular in cross section and said transport means is a rotatable auger.

14. The development apparatus of claim 12 wherein said developer dispensing apertures have substantially the same cross sectional area.

15. The development apparatus of claim 14 wherein said apertures are substantially circular in cross section.

16. The development apparatus of claim 12 wherein said toner supply means is a toner hopper and said developer supply means is a slot for receiving feedback portion of developer from the electrostatographic development apparatus.

17. The development apparatus of claim 12 wherein said developer dispensing apertures are at the bottom of said tube and parallel to the tube axis so that developer and toner fall by gravity through said apertures to the development apparatus.

18. The development apparatus of claim 12 wherein said geometric pattern of said apertures comprises a primary group of in line apertures having a spatial frequency between adjacent apertures lesser at the first end of said tube than at the opposite end of said tube.

19. The development apparatus of claim 18 wherein said primary group of in line apertures are arranged in a plurality of sets of at least two apertures with the apertures of each set having a spatial frequency substantially the same and the apertures in successive sets from said first end to said opposite end being of greater spatial frequency with respect to the immediately preceding adjacent set.

20. The development apparatus of claim 18 wherein said geometric pattern includes at least one secondary group of in line apertures spaced above the primary group of in line apertures.

21. The development apparatus of claim 20 wherein said secondary group of in line apertures extend substantially from said first end of said tube to about the midpoint of said tube and includes at least one aperture at the end of the primary group of in line apertures,

22. The development apparatus of claim 21 including a developer bail out gate at the opposite end of said tube.

* * * * *